US007596494B2

(12) United States Patent
Kristjansson et al.

(10) Patent No.: US 7,596,494 B2
(45) Date of Patent: Sep. 29, 2009

(54) METHOD AND APPARATUS FOR HIGH RESOLUTION SPEECH RECONSTRUCTION

(75) Inventors: Trausti Thor Kristjansson, Redmond, WA (US); John R. Hershey, San Diego, CA (US)

(73) Assignee: Microsoft Corporation, Redmond, WA (US)

( * ) Notice: Subject to any disclaimer, the term of this patent is extended or adjusted under 35 U.S.C. 154(b) by 743 days.

(21) Appl. No.: 10/722,937

(22) Filed: Nov. 26, 2003

(65) Prior Publication Data

US 2005/0114117 A1 May 26, 2005

(51) Int. Cl.
*G10L 21/02* (2006.01)

(52) U.S. Cl. ..... 704/226; 704/227; 704/228

(58) Field of Classification Search ..... 704/206, 704/223, 226, 200, 227, 228, 203, 205, 233
See application file for complete search history.

(56) References Cited

U.S. PATENT DOCUMENTS

| | | | | |
|---|---|---|---|---|
| 5,148,489 | A | 9/1992 | Erell et al. | 704/226 |
| 5,924,065 | A | 7/1999 | Eberman et al. | 704/231 |
| 6,026,359 | A | 2/2000 | Yamaguchi et al. | 704/256 |
| 6,067,517 | A | 5/2000 | Bahl et al. | 704/256 |
| 6,188,976 | B1 | 2/2001 | Ramaswamy et al. | 704/9 |
| 6,195,632 | B1 * | 2/2001 | Pearson | 704/206 |
| 6,202,047 | B1 | 3/2001 | Ephraim et al. | 704/256 |
| 6,633,842 | B1 | 10/2003 | Gong | 704/233 |

OTHER PUBLICATIONS

U.S. Appl. No. 09/999,576, filed Nov. 15, 2001, Attias et al.
U.S. Appl. No. 09/812,524, filed Mar. 20, 2001, Acero et al.
A. P. Varga and R. K. Moore, "Hidden Markov Model Decomposition of Speech and Noise," in Proceedings of the International Conference on Acoustics, Speech and Signal Processing, IEEE Press., pp. 845-848 (1990).
S. Boll, "Suppression of Acoustic Noise in Speech Using Spectral Subtraction," IEEE Transactions on Acoustics, Speech and Signal Processing, vol. 27, pp. 114-120 (1979).
L. Deng, A. Acero, M. Plumpe & X. D. Huang, "Large-Vocabulary Speech Recognition Under Adverse Acoustic Environments," in Proceedings of the International Conference on Spoken Language Processing, pp. 806-809 (Oct. 2000).
A. Acero, L. Deng, T. Kristjansson and J. Zhang, "HMM Adaptation Using Vector Taylor Series for Noisy Speech Recognition," in Proceedings of the International Conference on Spoken Language Processing, pp. 869-872 (Oct. 2000).

(Continued)

*Primary Examiner*—Huyen X. Vo
(74) *Attorney, Agent, or Firm*—Theodore M. Magee; Westman, Champlin & Kelly, P.A.

(57) ABSTRACT

A method and apparatus identify a clean speech signal from a noisy speech signal. The noisy speech signal is converted into frequency values in the frequency domain. The parameters of at least one posterior probability of at least one component of a clean signal value are then determined based on the frequency values. This determination is made without applying a frequency-based filter to the frequency values. The parameters of the posterior probability distribution are then used to estimate a set of frequency values for the clean speech signal. A clean speech signal is then constructed from the estimated set of frequency values.

16 Claims, 5 Drawing Sheets

OTHER PUBLICATIONS

Y. Ephraim, "Statistical-Model-Based Speech Enhancement Systems," Proc. IEEE, 80(10):1526-1555 (1992).

M.S. Brandstein, "On the Use of Explicit Speech Modeling in Microphone Array Application" In Proc. ICASSP, pp. 3613-3616 (1998).

A. Dembo and O. Zeitouni, "Maximum A Posteriori Estimation of Time-Varying ARMA Processes from Noisy Observations," IEEE Trans. Acoustics, Speech and Signal Processing, 36(4): 471-476 (1988).

P. Moreno, "Speech Recognition in Noisy Environments," Carnegie Mellon University, Pittsburgh, PA, pp. 1-130 (1996).

B. Frey, "Variational Inference and Learning in Graphical Models," University of Illinois at urbana, 6 pages (undated).

Y. Ephraim and R. Gray, "A Unified Approach for Encoding Clean and Noisy Sources by Means of Waveform and Autoregressive Model Vector Quantization," IEEE Transactions on Information Theory, vol. 34, No. 4, pp. 826-834 (Jul. 1988).

Y. Ephraim, "A Bayesian Estimation Approach for Speech Enhancement Using Hidden Markov Models," IEEE Transactions on Signal Processing, vol. 40, No. 4, pp. 725- 735 (Apr. 1992).

"Noise Reduction" downloaded from http://www.ind.rwth-aachen.de/research/noise_reduction.html, pp. 1-11 (Oct. 3, 2001).

A. Acero, "Acoustical and Environmental Robustness in Automatic Speech Recognition," Department of Electrical and Computer Engineering, pp. 1-141 (Sep. 13, 1990).

B. Frey et al., "ALGONQUIN: Iterating Laplace's Method to Remove Multiple Types of Acoustic Distortion for Robust Speech Recognition," In Proceedings of Eurospeech, 4 pages (2001).

R. Neal and G. Hinton, "A View of the EM Algorithm that Justifies Incremental, Sparse, and Other Variants," pp. 1-14 (undated).

J. Lim and A. Oppenheim, "All-Pole Modeling of Degraded Speech," IEEE Transactions on Acoustics, Speech, and Signal Processing, vol. ASSP-26, No. 3, pp. 197-210 (Jun. 1978).

M. Seltzer, J. Droppo, and A. Acero, "A Harmonic-Model-Based Front End for Robust Speech Recognition," *Eurospeech*, 2003.

J. Tabrikian, S. Dubnov, and Y. Dickalov, "Speech Enhancement by Harmonic Modeling Via Map Pitch Tracking," *In Proc. of ICASSP*, pp. 549-552, 2002.

B.J. Frey, T. Kristjansson, L. Deng, and A. Acero, "Learning Dynamic Noise Models from Noisy Speech for Robust Speech Recognition," *Advances in Neural Information Processing* (*NIPS*), 2001.

T. Kristjansson, *Speech Recognition in Adverse Environments: A Probabilistic Approach*, Ph.D. thesis, University of Waterloo, Ontario, Canada, Apr. 2002.

* cited by examiner

METHOD AND APPARATUS FOR HIGH RESOLUTION SPEECH RECONSTRUCTION

BACKGROUND OF THE INVENTION

The present invention relates to speech processing. In particular, the present invention relates to speech enhancement.

In speech recognition, it is common to condition the speech signal to remove noise and portions of the speech signal that are not helpful in decoding the speech into text. For example, it is common to apply a frequency-based transform to the speech signal to reduce certain frequencies in the signal that do not aid in decoding the speech signal. One common frequency-based transform is known as a Mel-Scale transform that reduces pitch harmonics in the speech signal. Mel-Scale transforms are used because the pitch at which someone speaks does not affect the listener's ability to discern what is being said. By removing these harmonics, smaller speech models can be constructed because they do not have to be trained to decode speech at different pitches. Instead, the Mel-scale transform creates pitch-independent models that can be used to decode speech of any pitch.

Speech systems also attempt to enhance the speech signal by removing noise before performing speech recognition. Under some systems, this is done in the time domain by applying a noise filter to the speech signal. In other systems, this enhancement is performed using a two-stage process in which the pitch of the speech is first tracked using a pitch tracker and then the pitch is used to separate the speech signal from the noise. For various reasons, such two-stage processing is undesirable.

A third system for removing noise from a speech signal attempted to identify a clean speech signal in a noisy signal using a probabilistic framework that provided a Minimum Mean Square Error (MMSE) estimate of the clean signal given a noisy signal. This system was designed for speech recognition and as such relied on feature vectors that were appropriate for speech recognition. In particular, this probabilistic system used speech vectors that were produced using the Mel-scale transform.

Although this probabilistic system did not require two-stage processing, it was less than ideal for speech enhancement because the Mel-Scale transform removed information from the signal. Because of this loss of information, it is extremely difficult, if not impossible, to reconstruct a speech signal from the "cleaned" signal that humans can easily understand.

Thus, the current systems for enhancing speech are less than ideal since they either require a two-stage process or make it impossible to reconstruct a clean intelligible speech signal.

SUMMARY OF THE INVENTION

A method and apparatus identify a clean speech signal from a noisy speech signal. The noisy speech signal is converted into frequency values in the frequency domain. The parameters of at least one posterior probability of at least one component of a clean signal value are then determined based on the frequency values. This determination is made without applying a frequency-based filter to the frequency values. The parameters of the posterior probability distribution are then used to estimate a set of frequency values for the clean speech signal.

DETAILED DESCRIPTION OF ILLUSTRATIVE EMBODIMENTS

Figure 1:
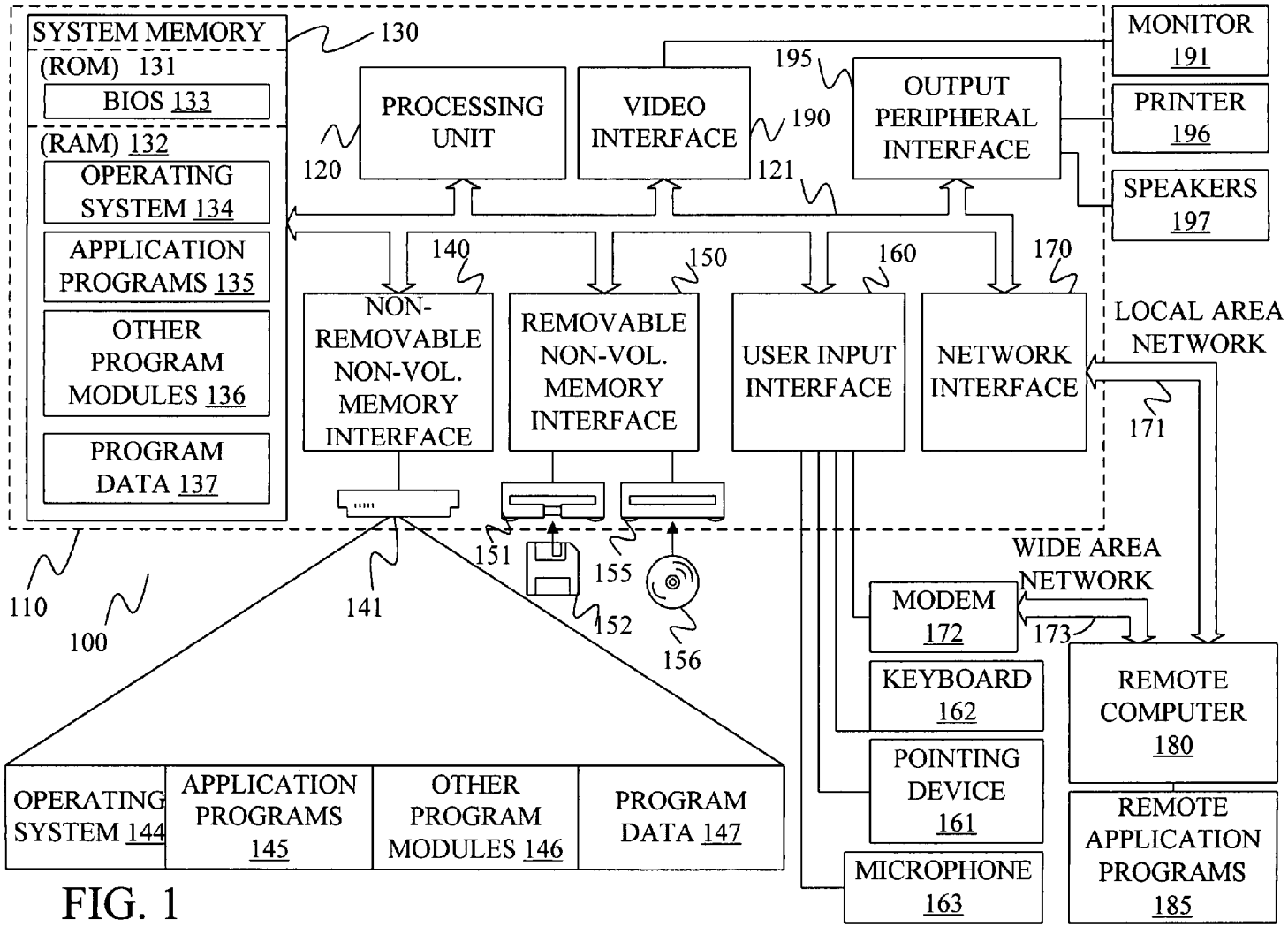
FIG. 1 is a block diagram of a general computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention is designed to be practiced in distributed computing environments where tasks are performed by remote processing devices that are linked through a communications network. In a distributed computing environment, program modules are located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 is operated in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
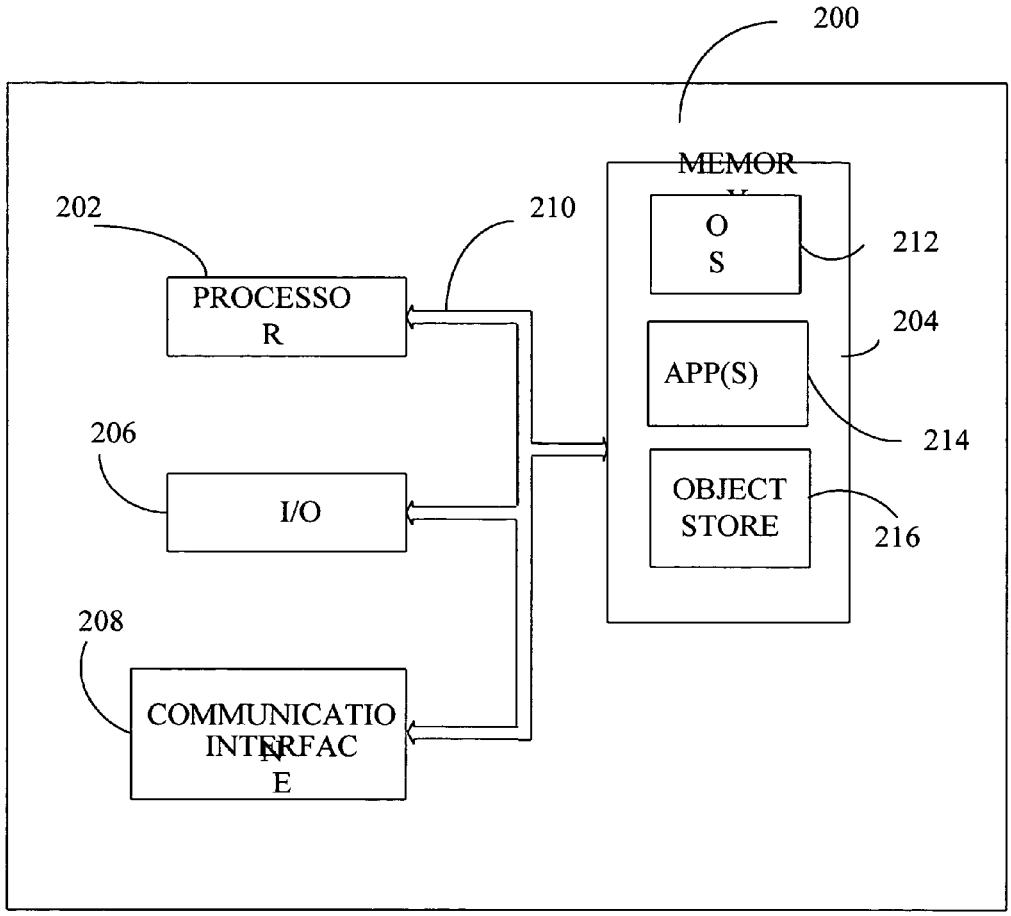
FIG. 2 is a block diagram of a mobile device in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Figure 3:
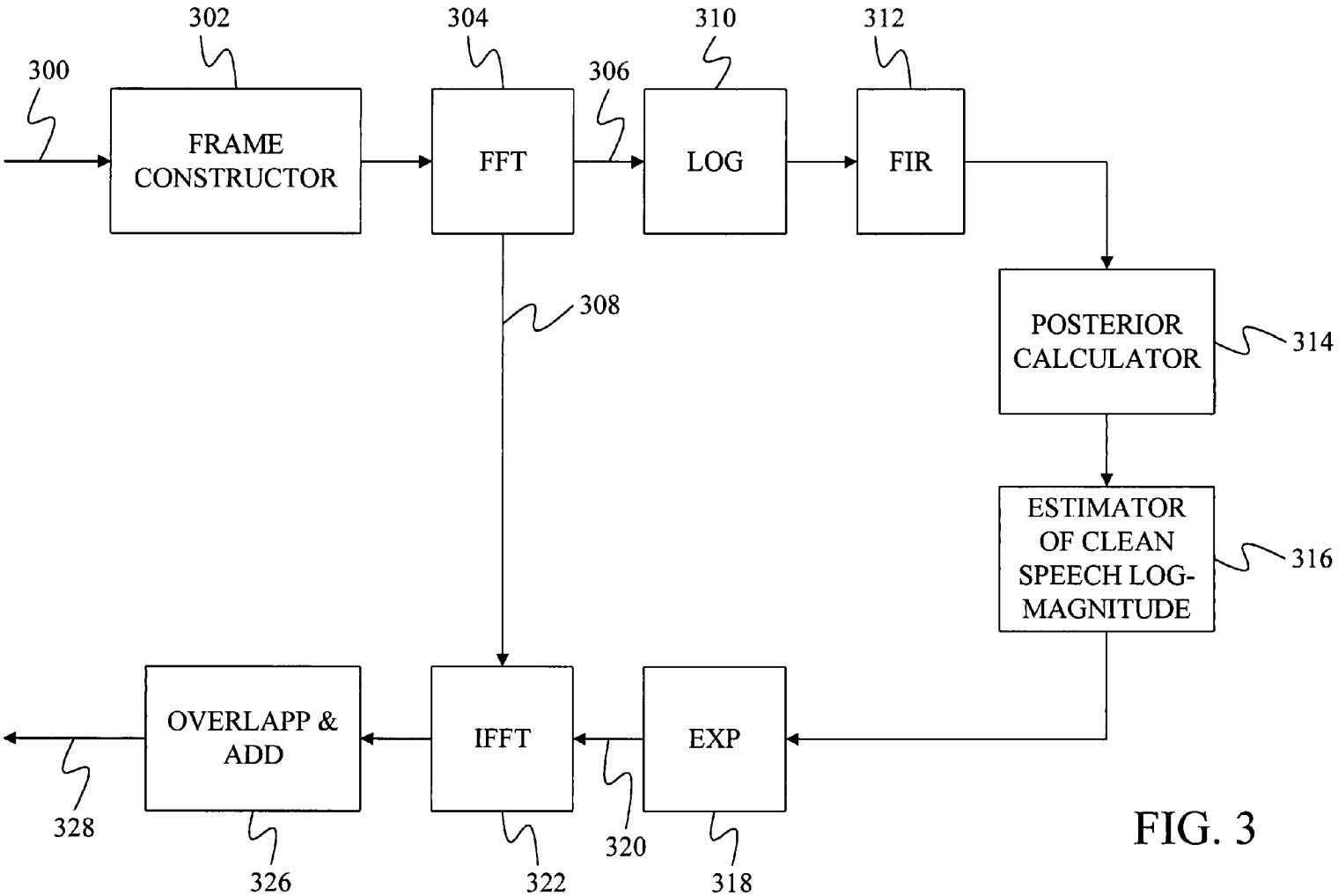
FIG. 3 is a block diagram of a speech enhancement system under one embodiment of the present invention.
Figure 4:
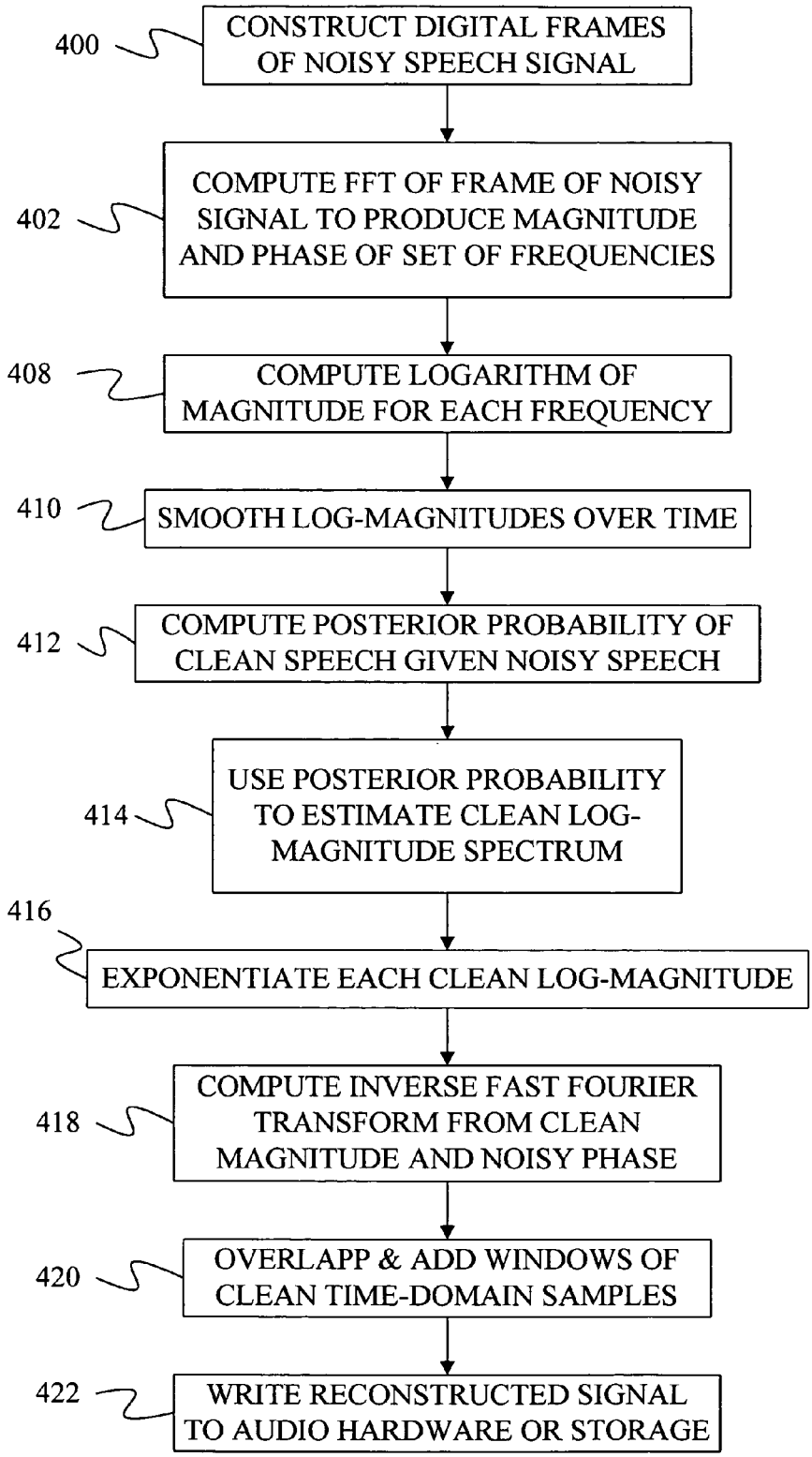
FIG. 4 is a flow diagram of a speech enhancement method under one embodiment of the present invention.

The present invention provides a method and apparatus for reconstructing a speech signal using high resolution speech vectors. FIG. 3 provides a block diagram of the system and FIG. 4 provides a flow diagram of the method of the present invention.

At step 400, a noisy analog signal 300 is converted into a sequence of digital values that are grouped into frames by a frame constructor 302. Under one embodiment, the frames are constructed by applying analysis windows to the digital values where each analysis window is a 25 millisecond hamming window, and the centers of the windows are spaced 10 milliseconds apart.

At step 402, a frame of the digital speech signal is provided to a Fast Fourier Transform 304 to compute the phase and magnitude of a set of frequencies found in the frame. Under one embodiment, Fast Fourier Transform 304 produces noisy magnitudes 306 and phases 308 for 128 frequencies in each frame. The phases 308 for the frequencies are stored for later use. A log function 310 is applied to magnitudes 306 at step 408 to compute the logarithm of each magnitude.

At step 410, the logarithm of each magnitude is provided to a finite impulse response (FIR) filter 312, which filters each magnitude over time. Under one embodiment, the FIR filter uses three consecutive frames for filtering using filter parameters of (0.25 0.5 0.25). This smoothes the log magnitudes and reduces spurious errors.

The filtered log magnitudes are provided as a vector of magnitude values to a posterior calculator 314, which computes a posterior probability for the vector at step 410. The posterior probability provides the probability of a clean speech log magnitude vector given the noisy speech filtered log magnitude vector. Under one embodiment, a mixture model is used consisting of a mixture of different posterior components, each having a mean and variance. Under one specific embodiment, a mixture model consisting of 512 male speaker mixture components and 512 female speaker mixture components is used. One technique for computing the posterior probabilities is discussed further below in connection with FIG. 5.

At step 414 the posterior probability is used to compute an estimate of the clean log magnitude spectrum using an estimator 316. Under one embodiment, the estimate of the clean log magnitude spectrum is a weighted average of the minimum mean square error estimates calculated from each of the mixture components of the posterior probability.

The estimated clean signal log magnitude values are exponentiated at step 416 by an exponent function 318 to produce estimates of the clean magnitudes 320. At step 418, an inverse Fast Fourier Transform 322 is applied to the clean magnitudes 320 using the stored phases 308 taken from the noisy signal at step 402 above. The inverse Fast Fourier Transform results in a frame of time domain digital values for the frame.

At step 420 an overlap and add unit 326 is used to overlap and add the frames of digital values produced by the inverse Fast Fourier Transform to produce a clean digital signal 328. Under one embodiment, this is done using synthesis windows that are designed to provide perfect reconstruction when the analyzed signal is perfect and to reduce edge effects. Under one particular embodiment, when an analysis window of a(s) is used, the synthesis window, b(s) is defined as:

$$b(s) = \frac{a(s)}{\sum_i a^2(s - i\tau)} \qquad \text{EQ. 1}$$

where $\tau$ is the time period between the beginning of successive analysis windows and the summation is taken over the number of windows.

The output clean digital signal 328 can then be written to output audio hardware so that it is perceptible to users or stored at step 422.

As shown above, the present invention does not apply a frequency-based transform to the noisy log-magnitude values before determining the posterior probability. A frequency-based transform is one in which the level of filtering applied to a frequency is based on the identity of the frequency or the magnitudes of the frequencies are scaled and combined to form fewer parameters. (Note that the FIR filter in FIG. 3 is a time-domain filter that filters across different frames in time. It does not filter based on the identity of the frequency but instead filters based on the value of the frequency component at different times.) In particular, the present invention does not apply a Mel-Scale transform as was conventionally done in the prior art. This results in a high resolution feature vector being applied to the posterior probability calculation.

By retaining all of the frequencies in the feature vector, the present invention provides a better posterior calculation, and thus a better estimate for the clean speech frequencies. In addition, because the number of frequency bins has not been reduced, the reconstructed signal is more intelligible, since information was not lost through a Mel-Scale transform.

Figure 5:
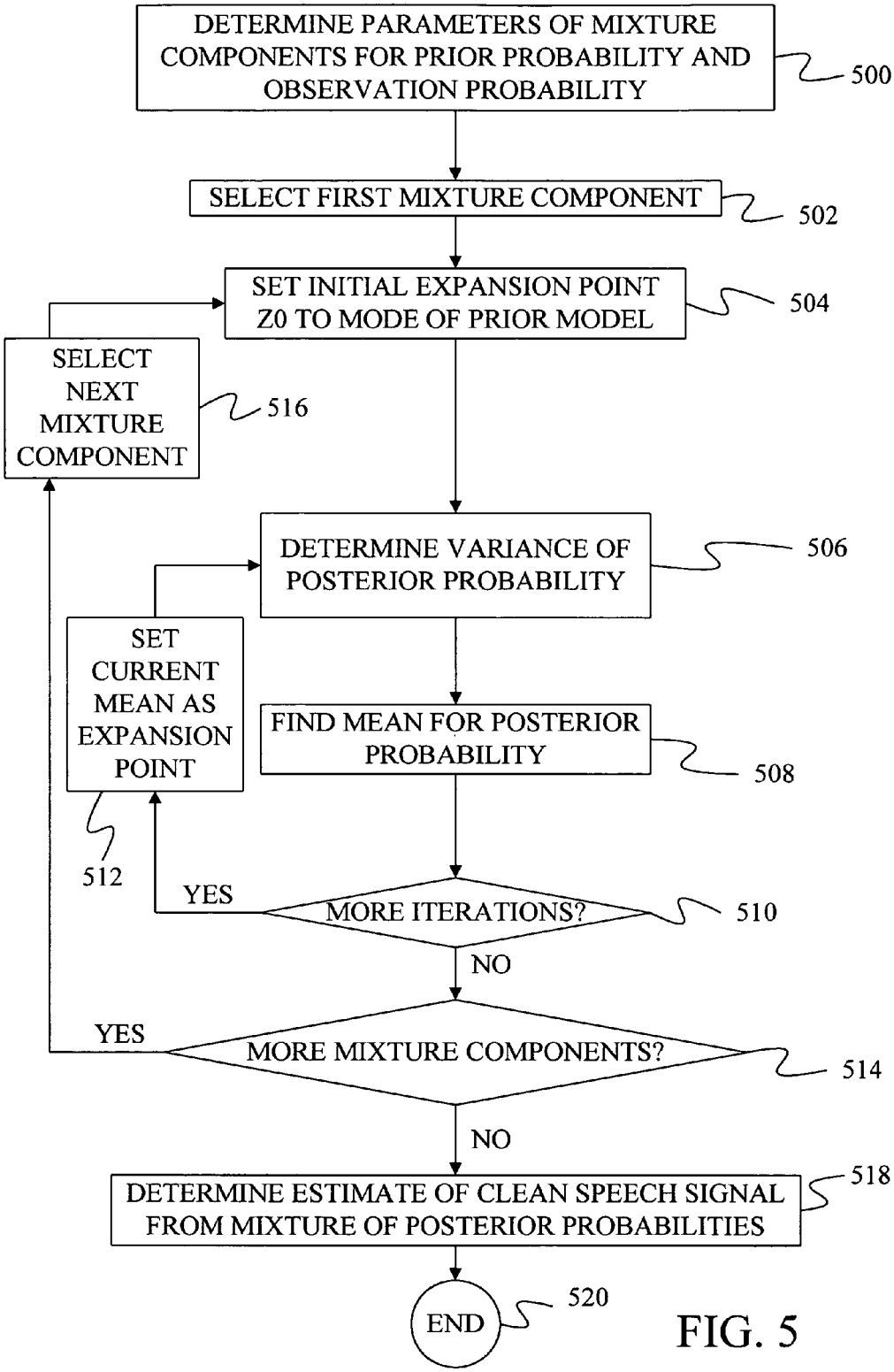
FIG. 5 is a flow diagram for determining a posterior probability of a clean signal given a noisy signal under one embodiment of the present invention.

A process for identifying the posterior probability p(nxc|y) of noise channel distortion, c, and clean signal, x, given a noisy signal y, is shown in FIG. 5. The process of FIG. 5 begins at step 500 where the means and variances for the mixture components of a prior probability p(n,x,c), and an observation probability p(y|n,x,c) are determined.

To generate the means and variances of the prior probability, the process of one embodiment of the present invention first generates a mixture of Gaussians that describes the distribution of a set of training noise feature vectors, a second mixture of Gaussians that describes a distribution of a set of training channel distortion feature vectors, and a third mixture of Gaussians that describes a distribution of a set of training clean signal feature vectors. The mixture components can be formed by grouping training feature vectors using a maximum likelihood training technique or by grouping training feature vectors that represent a temporal section of a signal together. Those skilled in the art will recognize that other techniques for grouping the feature vectors into mixture components may be used and that the two techniques listed above are only provided as examples. Under one embodiment, one mixture component is used for noise, one mixture component is used for channel distortion, and 128 mixture components are used for clean speech.

After the training feature vectors have been grouped into their respective mixture components, the mean and variance of the feature vectors within each component is determined. In an embodiment in which maximum likelihood training is used to group the feature vectors, the means and variances are provided as by-products of grouping the feature vectors into the mixture components.

After the means and variances have been determined for the mixture components of the noise feature vectors, clean signal feature vectors, and channel feature vectors, these mixture components are combined to form a mixture of Gaussians that describes the total prior probability. Using one technique, the mixture of Gaussians for the total prior probability will be formed at the intersection of the mixture components of the noise feature vectors, clean signal feature vectors, and channel distortion feature vectors.

The variances of the mixture components of the observation probability are determined using a closed form expression of the form:

$$\Psi = \mathrm{VAR}(y \mid x, n) = \frac{\alpha^2}{\cosh((n-x)/2)^2} \qquad \text{EQ. 2}$$

where $\alpha$ is estimated from the training data.

Under other embodiments, these variances are formed using a training clean signal, a training noise signal, and a set of training channel distortion vectors that represent the channel distortion that will be applied to the clean signal and noise signal.

The training clean signal and the training noise signal are separately converted into sequences of feature vectors. These feature vectors, together with the channel distortion feature vectors are then applied to an equation that approximates the relationship between observed noisy vectors and clean signal vectors, noise vectors, and channel distortion vectors. Under one embodiment, this equation is of the form:

$$\underline{y} \approx \underline{c} + \underline{x} + (\ln(1 + e^{([\underline{n}-\underline{c}-\underline{x}])})) \qquad \text{EQ. 3}$$

where $\underline{y}$ is an observed noisy feature vector, $\underline{c}$ is a channel distortion feature vector, $\underline{x}$ is a clean signal feature vector, and $\underline{n}$ is a noise feature vector. In equation 3:

$$\ln\left(1 + e^{([\underline{n}-\underline{c}-\underline{x}])}\right) = \begin{bmatrix} \ln(1 + e^{([n_1 - c_1 - x_1])}) \\ \ln\left(1 + e^{([n_j - c_j - x_j])}\right) \\ \vdots \\ \ln(1 + e^{([n_J - c_J - x_J])}) \end{bmatrix} \qquad \text{EQ. 4}$$

where $n_j$, $c_j$, and $x_j$ are the jth elements in the noise feature vector, channel feature vector, and clean signal feature vector, respectively.

Under one embodiment, the training clean signal feature vectors, training noise feature vectors, and channel distortion feature vectors used to determine the mixture components of the prior probability are reused in equation 3 to produce calculated noisy feature vectors. Thus, each mixture component of the prior probability produces its own set of calculated noisy feature vectors.

The training clean signal is also allowed to pass through a training channel before being combined with the training noise signal. The resulting analog signal is then converted into feature vectors to produce a sequence of observed noisy feature vectors. The observed noisy feature vectors are aligned with their respective calculated noisy feature vectors so that the observed values can be compared to the calculated values.

For each mixture component in the prior probability, the average difference between the calculated noisy feature vectors associated with that mixture component and the observed noisy feature vectors is determined. This average value is used as the variance for the corresponding mixture component of the observation probability. Thus, the calculated noisy feature vector produced from the third mixture component of the prior probability would be used to produce a variance for the third mixture component of the observation probability. At the end of step 500 a variance has been calculated for each mixture component of the observation probability.

After the parameters of the mixture components of the prior probability and the observation probability have been determined, the process of FIG. 5 continues at step 502 where the first mixture component of the prior probability and the observation probability is selected.

Due to the non-linear relationship in Equation 3, the true posterior is non-Gaussian. However, under one embodiment of the invention, the posterior is approximated as a Gaussians. In order to make this approximation, a linear approximation of Equation 3 must be made. This is done using a first order Taylor series expansion of:

$$y \approx g(z_o) + g'(z_o)(z - z_o) \qquad \text{EQ. 5}$$

where z and $z_o$ are stacked vectors representing a combination of a noise vector, channel vector and clean signal vector such that $$z = [x^T n^T c^T] \qquad \text{EQ. 6}$$

$$z_o = [x_o^T n_o^T c_o^T] \qquad \text{EQ. 7}$$

and where $$g(z_o) = x_o + c_o + 1n(1 + e^{[n_o - c_o - x_o]}) \qquad \text{EQ. 8}$$

and $g'(z_o)$ is the derivative of $g(z_o)$ determined at expansion point $z_o$.

Using the Taylor series expansion, the variance and mean and variance of the posterior probability can be calculated iteratively using:

$$\underline{\eta} = \underline{\eta_p} + \Phi(\underline{\Sigma}^{-1}(\underline{\mu} - \underline{\eta_p}) + g'(\underline{\eta_p})^T \Psi^{-1}(\underline{y} - g(\underline{\eta_p}))) \qquad \text{EQ. 9}$$

$$\Phi = (\Sigma^{-1} + g'(\eta_p)^T \Psi^{-1} g'(\eta_p))^{-1} \qquad \text{EQ. 10}$$

where $\underline{\eta}$ is the newly calculated mean for the posterior probability of the current mixture, $\underline{\eta_p}$ is the mean for the posterior probability determined in a previous iteration, $\underline{\Sigma}^{-1}$ is the inverse of the covariance matrix for this mixture component of the prior probability, $\mu$ is the mean for this mixture component of the prior probability, $\Psi$ is the variance of this mixture component of the observation probability, $\Phi$ is the variance of the posterior probability for this mixture component, $g(\underline{\eta_p})$ is the right-hand side of equation 8 evaluated with the expansion point set equal to the mean of the previous iteration, $g'(\underline{\eta_p})$ is the matrix derivative of equation 8 calculated at the mean of the previous iteration, and $\underline{y}$ is the observed feature vector.

In equation 9, $\mu$, $\underline{\eta}$ and $\underline{\eta_p}$ are M-by-1 matrices where M is three times the number of elements in each feature vector. In particular, $\mu$, $\underline{\eta}$ and $\underline{\eta_p}$ are described by vectors having the form:

$$\underline{\mu};\ \underline{\eta};\ \underline{\eta_p}:: \quad \text{EQ. 11}$$

$$\begin{bmatrix} \frac{M}{3}\text{Elements For Clean Signal Feature Vector} \\ \frac{M}{3}\text{Elements For Noise Feature Vector} \\ \frac{M}{3}\text{Elements For Channel Distortion Feature Vector} \end{bmatrix}$$

Using this definition for $\mu$, $\underline{\eta}$ and $\underline{\eta_p}$, and using $\underline{\eta_p}$ as the expansion point $z_o$, Equation 8 above can be described as:

$$g(\underline{\eta_p}) = \underline{\eta_p}\left(\frac{2M}{3}+1:M\right) + \underline{\eta_p}\left(1:\frac{M}{3}\right) + \ln\left(1+e^{\left(\underline{\eta_p}\left(\frac{M}{3}+1:\frac{2M}{3}\right)-\underline{\eta_p}\left(\frac{2M}{3}+1:M\right)-\underline{\eta_p}\left(1:\frac{M}{3}\right)\right)}\right) \quad \text{EQ. 12}$$

where the designations in equation 12 indicate the spans of rows which form the feature vectors for those elements.

In equations 9 and 10, the derivative $g'(\underline{\eta_p})$ is a matrix of order $$\frac{M}{3}-\text{by}-M$$

where the element of row i, column j is defined as:

$$\left[\underline{g}(\underline{\eta_p})\right]_{i,j} = \frac{\partial\left[\underline{g}(\underline{\eta_p})\right]_i}{\partial\left[\underline{\eta_p}\right]_j} \quad \text{EQ. 13}$$

where the expression on the right side of equation 13 is a partial derivative of the equation that describes the ith element of $g(\underline{\eta_p})$ relative to the jth element of the $\underline{\eta_p}$ matrix. Thus, if the jth element of the $\underline{\eta_p}$ matrix is the fifth element of the noise feature vector, $n_5$, the partial derivative will be taken relative to $n_5$.

The iterative process for determining the means and variance of the posterior probability is shown in steps 504, 506, 508, 510 and 512 of FIG. 5. At step 504, the expansion point $z_o$ is set equal to the mean of the prior probability model. Thus, for the first iteration, $\eta_p=\mu$. At step 506, equation 10 is used to determine the variance $\Phi$. At step 508, the variance is used in equation 9 to update the mean of the posterior probability. After the mean and variance have been updated, the process determines if more iterations should be performed at step 510.

If more iterations are to be performed, the current mean $\eta$ is set as the past mean $\eta_p$ at step 512 so that the current mean is used as the expansion point in the next iteration. The process then returns to step 506. Steps 506, 508, 510 and 512 are then repeated until the desired number of iterations has been performed.

After the mean and variance for the first mixture component of the posterior probability has been determined, the process of FIG. 5 continues by determining whether there are more mixture components at step 514. If there are more mixture components, the next mixture component is selected at step 516 and steps 504, 506, 508, 510 and 512 are repeated for the new mixture component.

Once a mean and variance has been determined for each mixture component of the posterior probability, the process of FIG. 5 continues at step 514 where the mixture components are combined to identify a most likely clean signal feature vector given the observed noisy signal feature vector. Under one embodiment, the clean signal feature vector is calculated as:

$$x_{post} = \sum_{s=1}^{S} \rho_s \underline{\eta_s}\left(1:\frac{M}{3}\right) \quad \text{EQ. 14}$$

where S is the number of mixture components, $\rho_s$ is the weight for mixture component s, $$\underline{\eta_s}\left(1:\frac{M}{3}\right)$$

is the feature vector for the mean of the posterior probability of the clean signal, and $x_{post}$ is the weighted average value of the clean signal feature vector given the observed noisy feature vector.

The weight for each mixture component, $\rho_s$ is calculated as:

$$\rho_s = \frac{\pi_s e^{G_s}}{\sum_{i=1}^{S} \rho_i} \quad \text{EQ. 15}$$

where the dominator of equation 15 normalizes the weights by dividing each weight by the sum of all other weights for the mixture components. In equation 15, $\pi_s$ is a weight associated with the mixture components of the prior probability and is determined as:

$$\pi_s=\pi_s^x \cdot \pi_s^n \cdot \pi_s^c \quad \text{EQ. 16}$$

where $\pi_s^x$, $\pi_s^n$, and $\pi_s^c$ are mixture component weights for the prior clean signal, prior noise, and prior channel distortion, respectively. These weights are determined as part of the calculation of the mean and variance for the prior probability.

In equation 15, $G^s$ is a function that affects the weighting of a mixture component based on the shape of the prior probability and posterior probability, as well as the similarity between the selected mean for the posterior probability and the observed noisy vector and the similarity between the selected mean and the mean of the prior probability. Under one embodiment, the expression for $G^s$ is:

$$G_s = \left[ -\frac{1}{2}\ln|2\pi\underline{\Sigma}_s| + \frac{1}{2}\ln|2\pi\Phi_s| - \frac{1}{2}(\underline{y} - \underline{g}(\underline{\eta_s}))^T\Psi^{-1}(\underline{y} - \underline{g}(\underline{\eta_s})) - \frac{1}{2}(\underline{\eta_s} - \underline{\mu_s})^T\underline{\Sigma}_s^{-1}(\underline{\eta_s} - \underline{\mu_s}) \right. \quad \text{EQ. 17}$$

where $\ln|2\pi\underline{\Sigma}_s|$ involves taking the natural log of the determinant of $2\pi$ times the covariance of the prior probability, $\ln|2\pi\Phi_s|$ involves taking the natural log of the determinant of $2\pi$ times the covariance matrix of the posterior probability.

In other embodiments, the clean signal vector is estimated as:

$$x_{post} = \sum_s \rho_s \int xp(x \mid y)dx \quad \text{EQ. 18}$$

Those skilled in the art will recognize that there are other ways of using the mixture approximation to the posterior to obtain statistics. For example, the means of the mixture component with largest ρ can be selected. Or, the entire mixture distribution can be used as input to a recognizer.

Although a particular method for determining the posterior probability is discussed above, those skilled in the art will recognize that any technique for identifying the posterior probability may be used with the present invention.

Although the present invention has been described with reference to particular embodiments, workers skilled in the art will recognize that changes may be made in form and detail without departing from the spirit and scope of the invention.

What is claimed is:

1. A method of identifying a clean speech signal from a noisy speech signal, the method comprising:

a processor identifying a set of log-magnitude frequency values for each of a plurality of frames that represent the noisy speech signal;

the processor filtering the log-magnitude frequency values of the noisy speech signal to smooth the log-magnitude frequency values over time to form filtered noisy values by applying the log magnitude frequency values of the noisy speech signal to a Finite Impulse Responsive Filter having a set of filter parameters wherein at least one of the filter parameters of the set of filter parameters differs from another of the filter parameters of the set of filter parameters;

the processor determining parameters of at least one posterior probability distribution of at least one component of a clean signal value based on the set of filtered noisy values without applying a frequency-based transform to the set of filtered noisy values, the posterior probability distribution providing the probability of a log-magnitude frequency value for a clean speech signal given a filtered noisy value;

the processor using the parameters of the posterior probability distribution to estimate a set of log-magnitude frequency values for a clean speech signal; and the processor using the log-magnitude values for the clean speech signal to produce an output clean speech signal.

2. The method of claim 1 further comprising taking the exponent of each of the log-magnitude frequency values in the set of log-magnitude frequency values for the clean speech signal to produce a set of magnitude values for the clean speech signal.

3. The method of claim 2 further comprising transforming the set of magnitude values for the clean speech signal into a set of time domain values representing a frame of the clean speech signal.

4. The method of claim 3 wherein identifying a set of log-magnitude frequency values for a frame of the noisy speech signal comprises transforming a frame of the noisy speech signal into the frequency domain to form frequency values for the noisy speech signal and taking the log of the magnitude of the frequency values.

5. The method of claim 4 wherein transforming a frame of the noisy speech signal into the frequency domain further comprises generating a set of frequency phase values and wherein transforming the set of magnitude values for the clean speech signal into a set of time domain values further comprises using the set of frequency phase values to transform the set of magnitude values.

6. The method of claim 4 wherein transforming a frame of the noisy speech signal into the frequency domain comprises producing a set of more than one hundred frequency magnitude values.

7. The method of claim 1 wherein determining the parameters of at least one posterior probability distribution comprises utilizing an iterative process to determine the parameters.

8. The method of claim 1 wherein determining parameters of at least one posterior distribution comprises determining parameters for each of a set of mixture components.

9. A computer storage medium storing computer-executable instructions for performing steps comprising:

identifying log-magnitude frequency values for each of a plurality of frames that represent a noisy speech signal;

applying the log-magnitude frequency values that represent frames of the noisy speech signal to a Finite Impulse Response filter having a set of filter parameters wherein one of the filter parameters of the set of filter parameters differs from another filter parameter of the set of filter parameters to provide time-based filtering and to produce filtered values representing noisy speech;

determining a posterior probability based on the filtered values, wherein a frequency-based transform is not applied before the filtered values are used to determine the posterior probability and wherein the posterior probability provides the probability of log-magnitude frequency values for a clean speech signal given the filtered values;

using the posterior probability to estimate a log-magnitude frequency value for a frame of a clean speech signal; and using the log-magnitude frequency value for the frame of the clean speech signal to produce an output clean speech signal.

10. The computer storage medium of claim 9 wherein estimating a frame of a clean speech signal comprises estimating log-magnitude frequency values for the frame of the clean speech signal.

11. The computer storage medium of claim 9 further comprising taking the exponent of the log-magnitude frequency values for frames of the clean speech signal to form magnitude values.

12. The computer-readable storage medium of claim 11 further comprising transforming the magnitude values into time-domain values representing a frame of the clean speech signal.

13. The computer storage medium of claim 12 wherein transforming the magnitude values comprises performing an inverse Fast Fourier Transform.

14. The computer storage medium of claim 13 wherein performing an inverse Fast Fourier Transform further comprises using phase values generated by converting the frames of the noisy speech signal from the time domain to the frequency domain.

15. The computer storage medium of claim 9 wherein determining a posterior probability comprises using an iterative process to determine the posterior probability.

16. The computer storage medium of claim 9 wherein determining a posterior probability comprises determining a separate posterior probability for each mixture component in a set of mixture components.

* * * * *